United States Patent [19]

Audino, Jr. et al.

[11] 4,440,146

[45] Apr. 3, 1984

[54] STOVE

[76] Inventors: Vincent Audino, Jr.; William P. Russ, both of P.O. Box 18668, San Jose, Calif. 95158

[21] Appl. No.: 237,490

[22] Filed: Feb. 23, 1981

[51] Int. Cl.[3] ..... F24C 1/14

[52] U.S. Cl. ..... 126/77; 126/112; 126/121; 126/163 R

[58] Field of Search ..... 126/163 R, 121, 77, 126/112

[56] References Cited

U.S. PATENT DOCUMENTS

| | | | |
|---|---|---|---|
| 1,908,854 | 5/1933 | Little | 126/163 R |
| 2,497,486 | 2/1950 | Barber | 126/120 |
| 2,543,289 | 2/1951 | Howes et al. | 126/77 |
| 2,725,874 | 12/1955 | Payne | 126/121 |
| 3,942,509 | 3/1976 | Sasser | 126/121 |
| 4,019,492 | 4/1977 | Rush | 126/163 R |
| 4,095,581 | 6/1978 | Billmeyer et al. | 126/143 |
| 4,106,475 | 8/1978 | Mayes | 126/121 |
| 4,213,446 | 7/1980 | Stookey et al. | 126/126 |
| 4,271,815 | 6/1981 | Johnson | 126/121 |
| 4,300,526 | 11/1981 | McKay et al. | 126/77 |

*Primary Examiner*—Ronald C. Capossela

*Attorney, Agent, or Firm*—Jack M. Wiseman; Francis W. Anderson

[57] ABSTRACT

A stove, particularly adapted for burning wood, includes a system for delivery of air to the combustion chamber which features a plurality of elongated headers arranged to deliver air relatively uniformly along the entire length of the combustion chamber.

10 Claims, 8 Drawing Figures

STOVE

BACKGROUND OF THE INVENTION

Wood stoves have, of course, been used for centuries. In recent months there has been renewed interest in this type of heating means since the costs of other types of fuels, such as oil and natural gas, have risen considerably. Several types of stoves are now marketed and they are effective in varying degrees in heating the air in their vicinity. One aspect of combustion that has been largely neglected is the control of the delivery of air to the combustion chamber. As a result, air is directed to localized areas of the chamber in amounts that are only roughly controlled and, therefore, the fuel burns irregularly and nonuniformly and different parts of the stove become hotter than other parts. Since stoves heat the surrounding air chiefly by radiation, a stove that has been unevenly heated by the fuel will provide uneven, undesirable heating of the area where it is located.

It is therefore an object of the present invention to provide a stove in which air is delivered relatively uniformly to the fuel and which has means for selectively controlling the delivery of air to different areas of the fuel.

SUMMARY OF THE INVENTION

The stove includes a housing, and means in the housing to define a combustion chamber. A pair of elongated headers extend longitudinally in the housing directly below the combustion chamber to deliver combustion air upwardly in a uniform pattern to the fuel along substantially the entire length of the combustion chamber. Air to each header is selectively controlled so that the air supply to one header can be completely shut off while full air is delivered to the other header, or air can be metered to either or both headers in quantities needed to promote burning throughout the entire length of the combustion chamber.

DESCRIPTION OF THE DRAWINGS

FIG. 8 is an enlarged isometric of a portion of FIG. 1 particularly showing the viewing window and the removable wall member disposed behind the window.

DESCRIPTION OF THE PREFERRED EMBODIMENT

Figure 1:
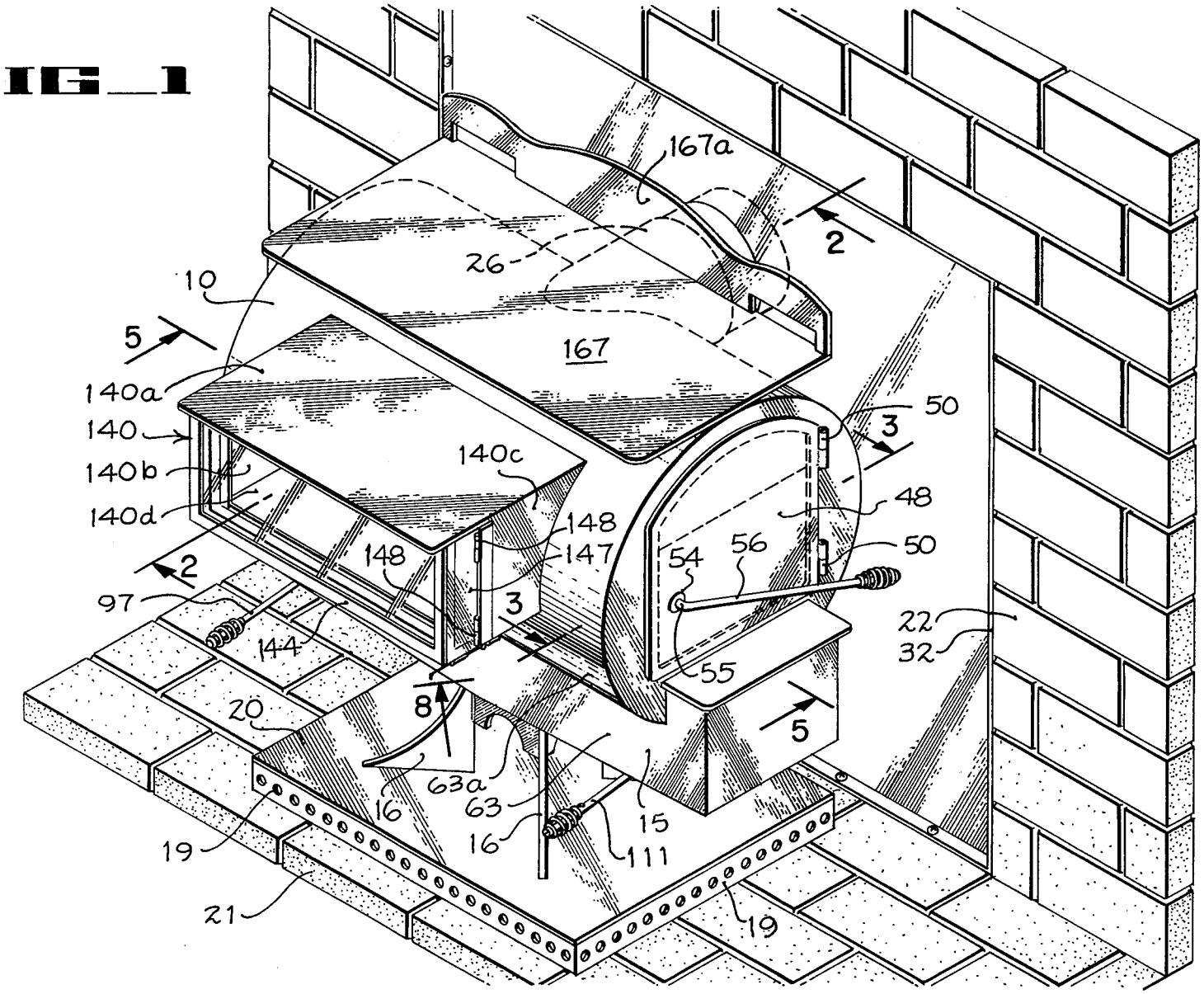
FIG. 1 is an isometric view of the stove of the present invention mounted in front of a typical household fireplace.
Figures 2, 3, 4:
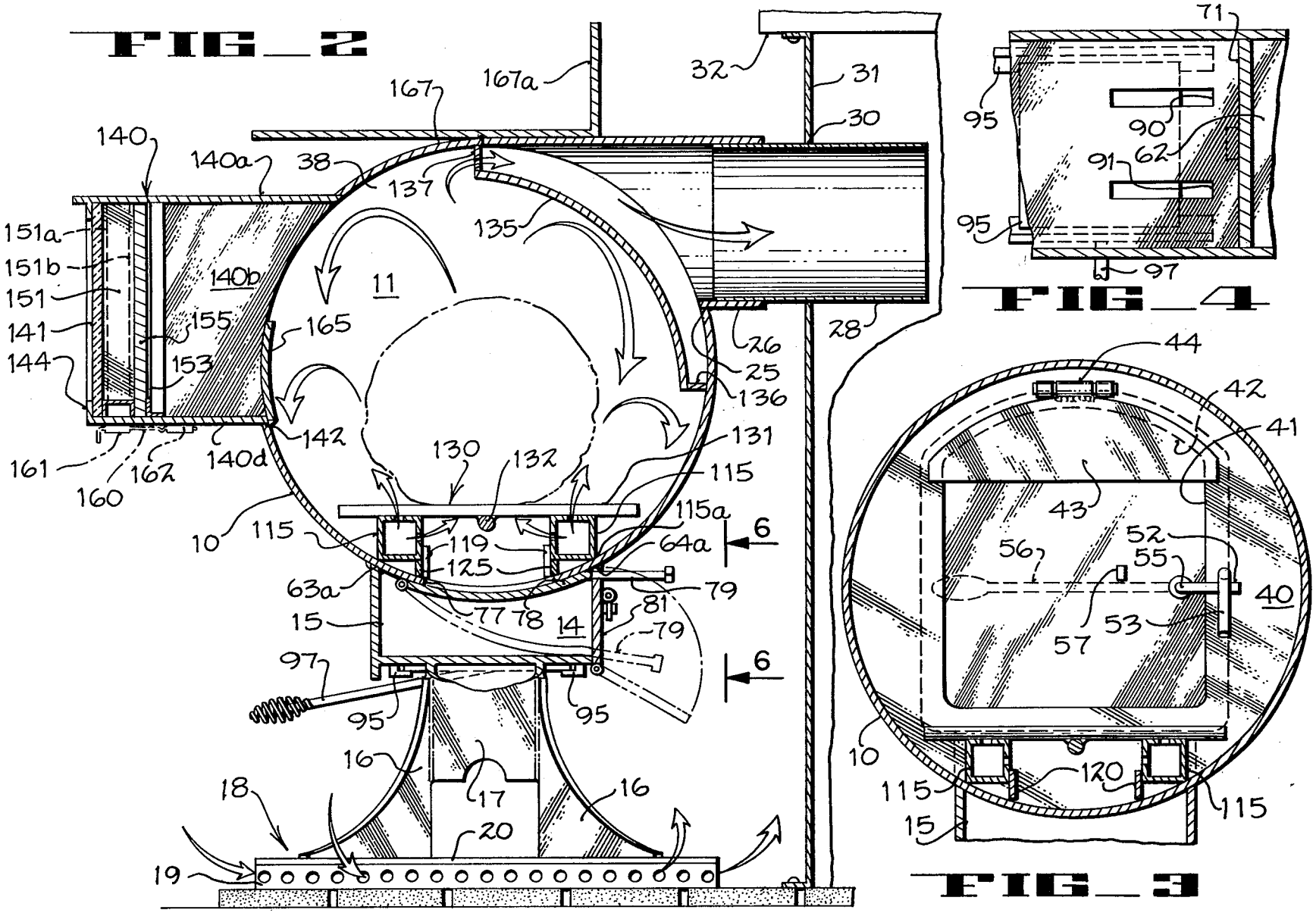
FIG. 2 is a vertical transverse section taken along line 2—2 of FIG. 1.
FIG. 3 is a vertical section taken along the line 3—3 of FIG. 1.
FIG. 4 is an enlarged horizontal section taken along line 4—4 of FIG. 5.

In FIGS. 1 and 2 the reference numeral 10 indicates a generally cylindrical steel housing enclosing a combustion chamber 11 which receives combustion air from a plenum chamber 14 provided by an elongated steel housing 15. The housing 10 is supported by the housing 15 which in turn is supported by a pedestal consisting of four vertical plates 16 (three only being shown) disposed at right angles to each other, the four plates being welded to the corner edges of a steel tube 17 which forms a downward extension of the housing 15. By varying the points of connection between the four plates with the edges of the tube, the height of the stove can be adjusted. At their lower edges, the plates 16 are welded to a platform 18 comprising four perforated side walls 19 (two only being shown) that are welded together to form a rectangular frame to which a top plate 20 is secured. The openings in the side walls 19 permit the circulation of cooling air under the plate 20 between the plate and the apron 21 in front of a fireplace 22.

The cylindrical housing 10 has an opening 25 in one side wall from which a short cylindrical exhaust pipe 26 is welded. A pipe extension 28, which telescopes into the exhaust pipe 26, extends in tight, sliding engagement through a circular opening 30 in a metal plate 31 that closes the room opening 32 of the fireplace 22. If the stove is designed for use away from a fireplace and a vertical discharge of combustion gases is desired, the exhaust pipe 26 is welded in the opening 25 in an upwardly-directed position.

One end of the housing 10 is closed by an imperforate end wall 38 (FIG. 2) while the other end is closed by a wall 40 (FIG. 3) that has an opening 41 therein through which fuel can be moved into the combustion chamber. The upper end of the opening 41 is defined by a curved wall edge 42, and a short plate 43 is pivoted by a hinge 44 to the inner surface of wall 40 at a point above the central portion of the curved edge 42. On the outer side of wall 40, a door 48 (FIG. 1) is pivotally mounted by hinges 50, the door 48 being large enough to cover the entire opening 41. The door is held in closed position by a bar 52 (FIG. 3) which swings up into a downwardly-opening slot (not shown) in a latch plate 53 welded to the inner face of end wall 40. The bar 52, which extends generally parallel to the wall 40, has a portion 55 (FIG. 1) bent at a right angle and extending through and journalled for rotation in a bushing 54 in wall 40. The bar 52 is swung into and out of the slot in the latch plate by means of a handle 56 that is integrally formed with the rotatable portion 55 and is disposed on the outer side of the door. As seen in FIG. 3, to open the door, the handle 56 which is on the outside of the door is raised upwardly, causing the bar 52 on the inside to swing downwardly out of the slot in the latch plate 53. When the handle is swung about 180° degrees, the bar 52 comes into contact with the lower side of an abutment member 57 on the inside of the door. The weight of the handle will maintain the bar 52 against member 57.

Figure 5:
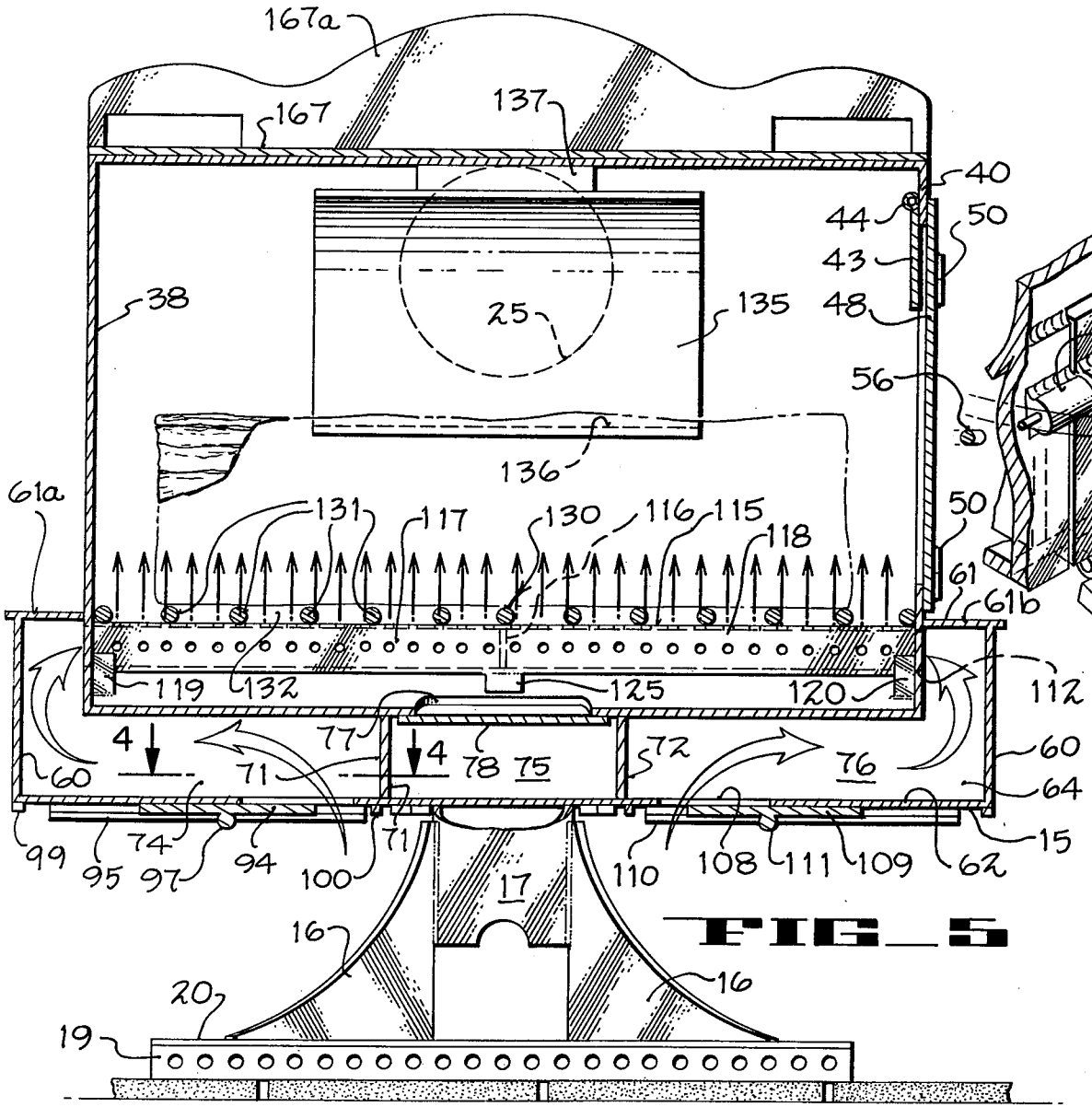
FIG. 5 is a vertical section taken along line 5—5 of FIG. 1.

The housing 15 of the air plenum chamber is an elongated box-like member made up of two end walls 60 (FIG. 5) a top wall 61, a bottom wall 62, and two side walls 63 (FIG. 1) and 64 (FIG. 5). Each side wall 63 and 64 has a relatively deep, rectangular cutout section 63*a* (FIG. 1) and 64*a* (FIG. 2), respectively, and the top wall 61 consists of two short sections 61*a* and 61*b* separated by an opening that extends across the entire width of the top wall and is coextensive in length with the cutout sections 63*a* and 64*a*. The cylindrical housing 10 is cradled in the openings in the top and side walls of the housing 15, being welded to the walls along the points where the two housings contact.

Figure 6:
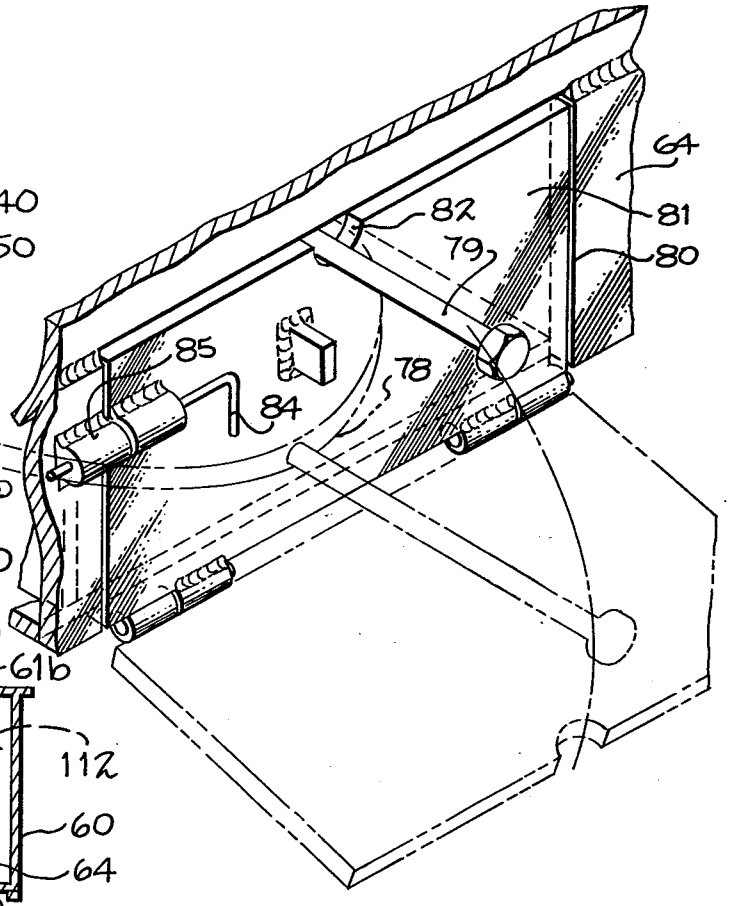
FIG. 6 is an enlarged isometric taken looking in the direction generally indicated by the line 6—6 of FIG. 2.

The housing 15 (FIG. 2) of the air supply chamber 14 is generally rectangular in cross-section and, as seen in FIG. 5, it is divided by a pair of spaced walls 71 and 72 into three longitudinal chambers 74, 75 and 76. The center chamber 75 is an ash pit located under the center portion of the combustion chamber and arranged to receive ashes from the chamber through an opening 77 (FIG. 2) in the housing 10. The opening is closed by a door 78 which is pivoted on the housing 10 and has a rod-like handle 79 projecting through an opening 80 (FIG. 6) in the side wall 64 of the housing 15. Access to the ash pit 75 is obtained through the opening 80 when a door 81, which is pivoted on housing 15, is moved to the open, phantom-line position of FIG. 6. When the door 81 is pivoted to its upright closed position, the handle 79 is received in a notch 82 in the door 81 to lock the ash pit door 78 in its upper closed position. When the door 81 is lowered to its open position, the ash pit door is permitted to swing down to the phantom line position of FIG. 6, causing ashes and the like to drop into the pit for removal through the side opening 80 in the housing 15. The door 81 is held in its raised position by a slide bolt 84 that is mounted on the door and adapted to be slid into an elongated opening in a receiver 85 secured to the housing 15 adjacent the door.

The chamber 74 in the air supply chamber receives air through a pair of slots 90 and 91 (FIGS. 4 and 5) in the lower wall 62 of the housing 15. Passage of air through the slots is controlled by a slide plate 94 that is slidably supported in ways 95 and has a laterally-extending actuator rod 97 connected to its under-surface. Stop lugs 99 and 100 that are mounted on the housing wall 62 limit the sliding movement of plate 94 in opposite directions. When the slide plate is in an open position, air passes upwardly into the chamber 74 and moves longitudinally toward the adjacent end wall 60 of the air supply housing 15. When it reaches wall 60 it is diverted in an upward and then inward direction through a pair of identical side-by-side openings 105 (one only being shown in FIG. 7) in the end wall 38 of the housing 10.

Similarly, the air chamber 76 receives air through a pair of side-by-side slots 108 in wall 62 that are identical in size and configuration to the slots 90 and 91 and are arranged to be opened and closed by a slide plate 109 slidably supported in spaced ways 110 and having a laterally-extending actuator rod 111. Air passing upwardly into chamber 76 moves toward the adjacent end wall 60. It is then directed upwardly and inwardly through two openings 112 in the end wall 40 of housing 10. The openings 112 are identical in size, configuration and orientation to the openings 105 in wall 38 of the housing 10, and each of the openings 112 is in alignment, longitudinally of the housing 15, with one of the openings 105.

It should be noted that a large part of the air passing longitudinally in the chambers 74 and 76 is in contact with the heated lower wall of the main housing 10 and, accordingly, it is preheated before it reaches the distribution headers.

When air passes through either pair of aligned openings 105, 112, it passes into opposite ends of one of two distribution headers 115 which have their ends disposed in tight slidable engagement with the inner faces of the end walls 38 and 40 of the combustion chamber housing. The square cross-section and the side-by-side positioning of the distribution headers 115 in the lower end of the combustion chamber is shown particularly in FIG. 2. A transverse wall 116 (FIG. 5) divides each header into two sections, 117 and 118.

Each header is positioned in the lower end of the combustion chamber with one side face abutting the inner faces of two flat bars 119 and 120 each of which is welded in upright position to the bottom wall of the housing 10 and to one end wall 38 or 40. A short flat strap 125 is welded to the side wall of each header and projects downwardly below the header into engagement with the curved inner surface of the housing. Thus, each header is supported by the strap 125 and by the engagement of one lower longitudinal edge **115*a* (FIG. 2) with the curved surface of the housing, and is oriented and located by its contact with the flat bars 119 and 120**.

Each header has a plurality of holes 128 extending through its top wall **115*b* and its inner wall 115*c*. The holes in each wall are $\frac{3}{4}''$ apart and the holes in wall 115*c* are offset relative to the holes in wall 115*b* by $\frac{3}{8}''$ so that each hole in wall 115*c* is spaced $\frac{3}{8}''$ measured longitudinally of the header from an adjacent hole in wall 115*b***. Each hole is $\frac{1}{4}''$ in diameter and each header is made from square steel tubing that has a $\frac{1}{8}''$ wall thickness and is 1.5 inches on a side.

A grate 130 (FIGS. 2 and 5) comprises a plurality of spaced transverse circular bars 131 welded to a longitudinal bar 132. The bars 131 of the grate straddle and rest on the two headers 115.

A curved deflector plate 135 is mounted in the upper rear portion of the combustion chamber by a flange 136 which extends between the lower end of the plate 135 and the rear wall of housing 10, and a flange 137 that extends between the upper edge of the plate and the top wall of the housing 10. It will be noted in FIG. 5 that the curved plate is disposed directly in front of the exhaust pipe opening 25 in the housing 10.

A box-like housing 140 (FIG. 1), which is mounted on the forward wall of the combustion chamber housing, carries a pane of glass 141 through which the fire can be viewed. The housing includes a top wall **140*a*, side walls 140*b* and 140*c*, and a bottom wall 140*d*, each wall member being welded to an adjacent member and to the housing 10 around the edges of an opening 142 that is generally rectangular in side elevation (FIG. 2). The front wall of housing 140 is provided by a peripheral flange 144 (FIG. 7) which is secured to the forward edges of the other walls. An opening 145 in the side wall 140*c* is arranged to be closed by a door 147 which is pivotally mounted on the wall by hinges 148. Positioned on the lower wall, close to but spaced rearwardly from flange 144 is a U-shaped bracket made up of three relatively shallow channels 149, 150 and 151. Each of the channels has spaced legs 149*a*–149*b*, 150*a*–150*b*, respectively, the legs of channel 149 extending downwardly while the legs of channels 150 and 151 extend outwardly. The legs 149*a*, 150*a* and 151*a* cooperate with the flange 144 to define a way in which the glass pane 141 slides. Similarly, the legs 149*b*, 150*b* and 151*b* cooperate with a flange 153, which is substantially the same in configuration as flange 144 and is secured inside the housing 140, to provide a way in which a steel plate 155 is slidably disposed. Plate 155 is provided with a plurality of through-holes 155*a***.

The door 147 is held in closed position by a slide bar 160 (FIG. 8) that is carried by a support tube 161 mounted on door 147 and is arranged to be slid into an opening in a tubular receiver 162 carried on the lower wall of the housing 140. The coaction of the slide bar with the receiver is shown in phantom-lines in FIG. 2, it being understood that this lock mechanism is not at the center of the housing but along the edge where the door is mounted as shown in FIG. 8.

A stop member 165 (FIG. 2) is mounted in upstanding position on the rear edge of the lower wall 140*d* of housing 140 to prevent a log or the like from rolling forwardly into the housing.

The upper wall 140*a* of the housing 140 is flat and serves as a surface on which articles to be warmed may be placed. Similarly a flat plate 167, which has an upstanding rear wall 167*a*, is secured in position on the upper wall of the housing 10 to receive heat from the combustion chamber and act as a primary heating surface for articles placed thereon.

Figure 7:
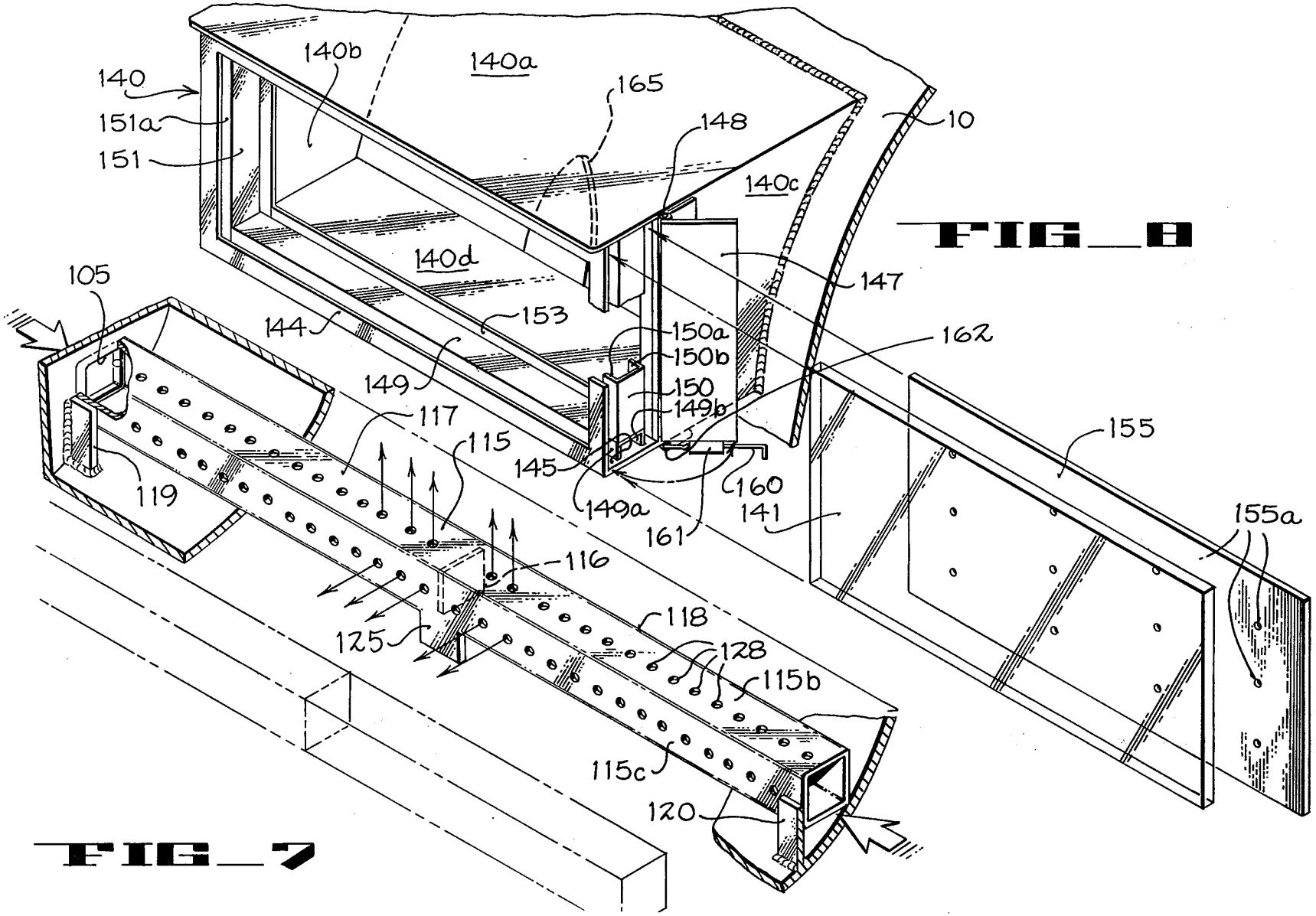
FIG. 7 is an enlarged fragmentary isometric of the air manifold of the stove that has been broken away to particularly disclose one of the air headers.

Referring to FIG. 7, it will be evident that the spaced holes 128 along the two headers 115 are effective to direct air upwardly into the fuel in uniform, substantially equal amounts along the entire length of each header. If the fire is burning unevenly along the length of the combustion chamber due to wood that has localized wet portions, one or both of the slide plates 94 and 109 can be adjusted to regulate the quantities of air supplied to the different ends of the header. For example, if a log on the grate appears to be receiving an excess of air at one end and is burning rapidly at that end while, for some reason, it is burning too slowly at the other end, the slide plates can be adjusted to regulate the quantities of air so that both ends will receive sufficient air to cause the log to burn substantially uniformly along its length.

When unattended and while the fire is burning, the plate 155 ordinarily will be positioned in the housing 140 to provide a fire wall to confine the flames. If it is necessary to inspect the fire, the door 147 can be opened and the plate 155 slid out part-way or all the way to permit the fire to be seen through the viewing window 141.

The embodiment of the stove of the present invention described above is made completely of steel except the glass viewing plate 141. It will be understood that other materials such as aluminum and cast iron may be used for certain parts. Also, while one arrangement of holes in the air distribution headers has been disclosed, other sizes and pattern of holes may be substituted if the combustion air requirements of the stove make them desirable.

We claim:

1. In a stove having a housing defining a combustion chamber in which fuel is burned, means for supplying combustion air, and air distribution means for receiving air from said supply means and directing it into the combustion chamber, said air supply means including a plenum chamber having two separate non-communicative compartments and said air distribution means includes a plurality of elongated distribution headers disposed longitudinally in the combustion chamber, each header being divided into two non-communicating sections, and means for directing the air from each of said plenum compartments into a separate one of the sections of a particular header for guidance into the combustion chamber independently of the passage of air from said plenum chamber into the other section of that header.

2. A stove according to claim 1 including means for metering the flow of outside air into each plenum compartment respectively.

3. In a stove having a combustion chamber in which fuel is burned, air distributing means including an elongate air distributor header disposed adjacent said combustion chamber to supply combustion air to said chamber;

means defining individual air passages communicating with said headers at spaced points longitudinally of said header; and adjustable means for varying the amount of air delivered to each of said air passages, said individual air passage means comprising separate non-communicating plenum chambers, and said header including an elongate perforated tube divided transversely to define aligned header sections.

4. The combination of claim 3 wherein said air distribution header comprises another perforated tube.

5. A stove according to claim 4 wherein said air passages communicate with each end of each tube for directing air into each tube.

6. A stove having a housing defining a combustion chamber in which fuel is burned, means for supplying combustion air, air distribution means for receiving air from said air supply means and directing it into the combustion chamber, said air supply means including means for guiding air over heated surfaces to preheat it before entering said air distribution means, said air supply means including an air plenum chamber, said air plenum chamber being divided into separate compartments, means defining an enclosed space between said compartments, said enclosed space being an ashpit, said housing having an opening communicating the ashpit with the outside, an ashpit door pivotally mounted on said housing over said opening in the housing, said ashpit door having a handle projecting through said opening in the housing in the path of pivotal movement of said ashpit door to be engaged and moved to closed position, and means for holding said ashpit door in closed position.

7. In a stove having a housing defining a combustion chamber in which fuel is burned;

air supply means including a plurality of separate, non-communicative air plenum chambers;

air distribution means communicating with said combustion chamber and having separate distributing sections, each section communicating with one of said plenum chambers;

and means for selectively varying the amount of air supplied to each plenum chamber respectively whereby air may be delivered to the combustion chamber in a selected quantity from each of said separate air distributing sections.

8. A stove according to claim 7 wherein said housing has an exhaust gas outlet in an upper wall, further including baffle means disposed adjacent the exhaust gas outlet for restricting access to the outlet and redirecting gases coming in contact with said baffle means.

9. A stove according to claim 8 wherein the housing is an elongated cylindrical member having the exhaust gas opening in an upper rear quadrant of the housing wall, and wherein said baffle means is an arcuate plate disposed inwardly from the inner surface of the housing in front of the exhaust gas outlet.

10. A stove according to claim 7 further including means defining an observation opening in one wall of said housing, a glass plate mounted in front of the opening for viewing the interior of the housing, and a non-transparent member slidably mounted adjacent said opening for preventing the viewing of the fire when said member is in position and permitting the viewing of the fire through said glass plate when slid to a withdrawn position.

* * * * *